US005848957A

United States Patent [19]

White, Jr. et al.

[11] Patent Number: 5,848,957

[45] Date of Patent: Dec. 15, 1998

[54] UPPER BODY CRUNCHER

[76] Inventors: Roosevelt White, Jr.; Jill White; Roosevelt White, Sr.; Gwendolyn White, all of 3156 Marietta St., Kenner, La. 70065

[21] Appl. No.: 850,396

[22] Filed: May 2, 1997

[51] Int. Cl.[6] ..... A63B 23/02

[52] U.S. Cl. ..... 482/140; 482/112; 482/133; 482/142

[58] Field of Search ..... 482/92, 95, 96, 482/112, 123, 131–137, 139, 140, 142, 908

[56] References Cited

U.S. PATENT DOCUMENTS

| | | | |
|---|---|---|---|
| 4,257,593 | 3/1981 | Keiser | 482/137 |
| 4,429,871 | 2/1984 | Flechner | 482/112 |
| 4,807,873 | 2/1989 | Naquin | 482/140 |
| 5,031,905 | 7/1991 | Walsh . | |
| 5,037,090 | 8/1991 | Fitzpatrick . | |
| 5,100,131 | 3/1992 | Fong | 482/112 |
| 5,441,473 | 8/1995 | Safani et al. . | |
| 5,492,520 | 2/1996 | Brown . | |
| 5,624,361 | 4/1997 | Lai | 482/137 |
| 5,695,436 | 12/1997 | Huang | 482/140 |
| 5,743,832 | 4/1998 | Sands et al. | 482/112 |

FOREIGN PATENT DOCUMENTS

| | | | |
|---|---|---|---|
| 1903502 | 8/1970 | Germany | 482/131 |

*Primary Examiner*—Jeanne M. Clark

*Attorney, Agent, or Firm*—Patent & Trademark Services; Tom Zack; Joseph H. McGlynn

[57] ABSTRACT

An exercise device used to develop a user's torso and upper body muscles. The device has a tubular support frame with two upper side members connected by a lateral support and two space curved side supports. An adjustable pull down handle is centered on the frame's lateral support. Four resistance pneumatic cylinder with pistons, two on each side, connect the upper side members to a lower support structure. The curved supports extend downwardly from each of the upper side supports and have a head rest strap connector between them. A head rest with a back support extends from it is connected to a lateral strap member to a lateral strap in the lower support. A user lies down and grasps and pulls the overhead handle. By pulling down towards their chest on the handle against the resistance cylinder and their pistons, the user exercises torso and upper body muscles. The handle may be adjusted to such that its free end portion points horizontally either to the center, right side or left side of the spaced upper members.

1 Claim, 2 Drawing Sheets

UPPER BODY CRUNCHER

BACKGROUND OF THE INVENTION

Exercise machines for different or multiple body muscle groups are found in the home, health establishments and other places. Normally, the user's muscles work against the resistive forces supplied by pistons, weights, springs, other resistive physical members or user's own other muscle groups. In the last few years abdominal exercise devices having interlocking tubular members into which the user is mounted while in a supine position have become very popular. The present invention relates to an exercise device having resistive member which is specifically targeted to develop the user's torso and upper body muscles while the user is in a comfortable supine position. Resistive forces counteract the user's applied downward force and a vertical and side wise adjustable handle permits the user to work against these forces as described herein.

DESCRIPTION OF THE PRIOR ART

Exercise devices specifically targeted to different muscle groups are known. For example, the exercising device in Walsh U.S. Pat. No. 5,031,905 has a freestanding tilt able body device for use on the abdomen and leg muscles of a user with a swivel mechanism attached to a shock absorber.

In Fitzpatrick U.S. Pat. No. 5,037,090 the exercising device can also function as seating. A dual hand bar is forcibly raised in conjunction with a piston and cylinder resistive device.

The Sanfani U.S. Pat. No. 5,441,473 describes a fold-down back exerciser used to work the user's back muscles with a pivoting arm that includes a resistance device.

In Brown U.S. Pat. No. 5,492,520 an abdominal exercise device is disclosed with a one-piece frame having arm resist and a neck rest. The user's own weight provides the resistance needed to work the device. The present invention relates to an exercise device having tubular support members with resistance pistons and a pull down vertical and side wise adjustable handle specifically targeted to torso and upper body muscles as more further set forth in this specification.

SUMMARY OF THE INVENTION

This invention relates to an exercise device used to develop a user's torso and upper body muscles. While lying down on the device's back support, the user grasps an overhead adjustable handle and pulls down toward their chest. This applied force works against resistance pistons on to the device to exercise the muscles. The handle may be adjusted to either the center, right or left side to develop and tone specific muscles groups.

It is the primary object of the present invention to provide for an improved exercise device having an adjustable handle.

Another object is to provide for such a device specifically designed to develop the user's torso and upper body muscles.

These and other objects and advantages of the present invention will become apparent to readers from a consideration of the ensuing description and the accompanying drawings.

DESCRIPTION OF THE PREFERRED EMBODIMENT

Figure 1:
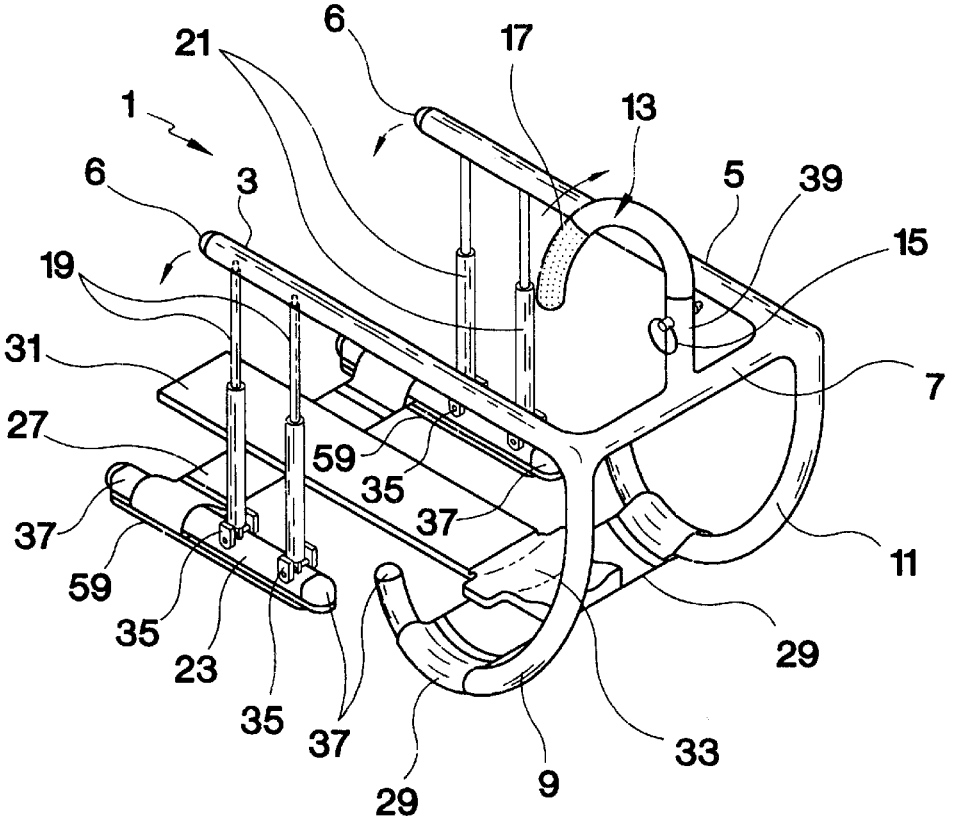
FIG. 1 is a front perspective view of the invention's preferred embodiment.

FIG. 1 is a front perspective view of the invention's preferred embodiment. A tubular steel hollow support frame 1 consists of two identical upper side parallel support members 3 and 5 with plastic inserted end caps 6 and joined together by a perpendicular lateral connecting support member 7; and two identical curved downwardly extending spaced parallel side members 9 and 11 connected to the upper support side members. All support frame members are rigidly joined together as a unitary structure. Extending upwardly from the center of upper lateral support 7 is the adjustable handle assembly 13 with a free end having a removal securing pin 15 and a padded foam handle end cover 17. Adjacent each of the free ends of the side supports 3 and 5 are a depending pair of spaced pneumatic cylinders with interrelated moving pistons (19 and 21, respectively) connected to the upper supports by screws. These two pairs of cylinders are vertically disposed and spaced from each other and connected at their other lower ends to the lower floor engaging support structure.

The lower floor engaging support structure has two spaced parallel side brace components members 23 and 25 connected to the cylinders/piston pairs: two lateral supporting joining straps 27 and 29 extending, respectively, around and between the ends of the brace members 23 and 25 and the lower curved side frame members 9 and 11. Each strap has its free end sewn together with a strap section to fastened it around a frame member. Centered between these two lateral supports is a back/spine support member 31 and the head rest/shoulder rest 33, as shown. Each of the cylinders/pistons is connected to a lower brace component by a "U" shaped pivot bracket 35 which permits pivotal movement in a back and forth direction while prohibiting side wise movement. Plastic end caps 37 may be inserted into the two opened ends of the curved members 9 and 11 and the four opened ends of the brace members 23 and 25.

Figure 2:
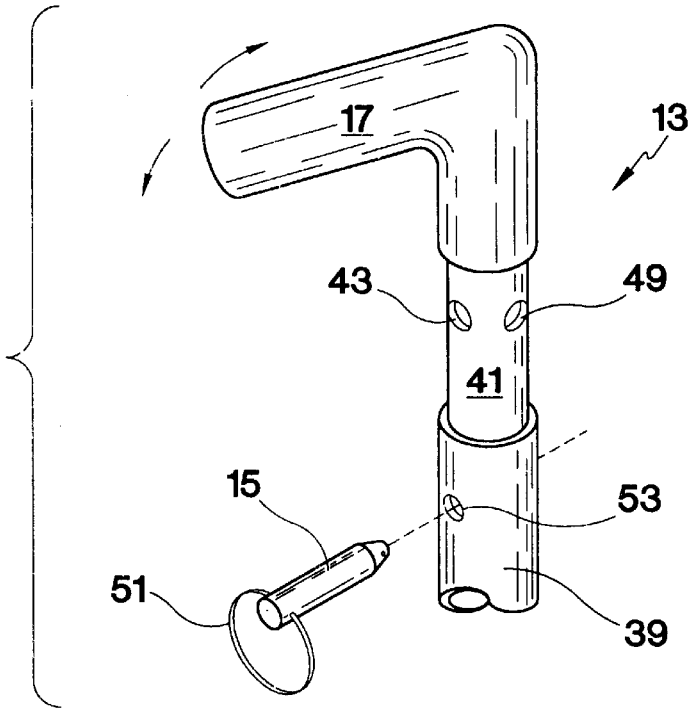
FIG. 2 is an enlarged side view of the adjustable handle used in the FIG. 1 embodiment.

FIG. 2 is an enlarged side view of the adjustable handle assembly 13 used in the FIG. 1 embodiment. Joined to the center of frame member 7 is the upright tubular support member 39 with its opened top end. Slidably inserted into this member's 39 opened end is the smaller tubular handle end 41 with horizontally disposed three different holes 43, 45 and 47 (not shown). Forming the upper part of the handle's exposed other end is the curved tubular section 49 part of which is covered by covering 17. The securing pin 15 has a ring loop 51 secured by holes to its back free end while its inserted front end fits into a hole 53 extending through the handle's upright member 39. When pin 15 is inserted into this member's hole 53 and aligned with one of the three holes in member 41 the upper handle section is fixed with respect to lower section 39 in its vertical and horizontal direction. By changing the particular aligned hole in member 41 in which the pin is inserted, the free upper handle end will be oriented to point in a different horizontal direction, i.e. to point between the two spaced side upper members 3 and 5 or towards either one of these two members. For example, if hole 43 corresponds to a left pointing direction for the handle end with covering 17 then hole 45 would correspond to a center or forward facing direction for the handle's free end and hole 47 to a right direction facing position. When exercising, this target lateral obliques, triceps and other isolated muscles groups the user would adjust the handle's free end to the left or right side and pull down on the handle to simultaneously "crunch" into his or her torso along a left or right angle.

Figure 3:
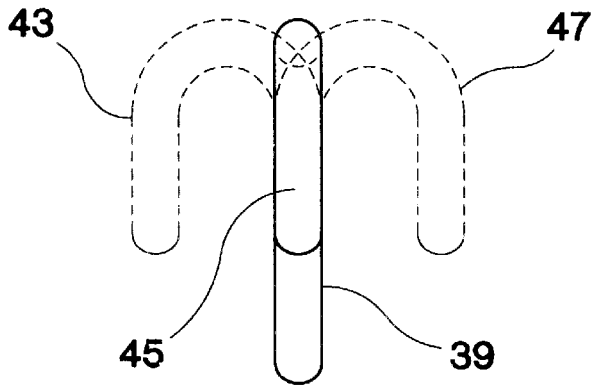
FIG. 3 shows the three movable side views for the handle.

FIG. 3 shows the three movable side views for the handle which is grasped in a hand-over-hand grip and pulled down toward's the center of the user's chest when centered (i.e. pin 15 in inserted into holes 53 and 45). In so doing muscle tone and strength for the user's deltoid, pectoral, abdominal and intercostal muscle groups would be strengthen and developed. The dotted lines shown represent the position of the handle's end if the pin 15 were inserted into aligned section 41 holes 43 or 47.

Figure 4:
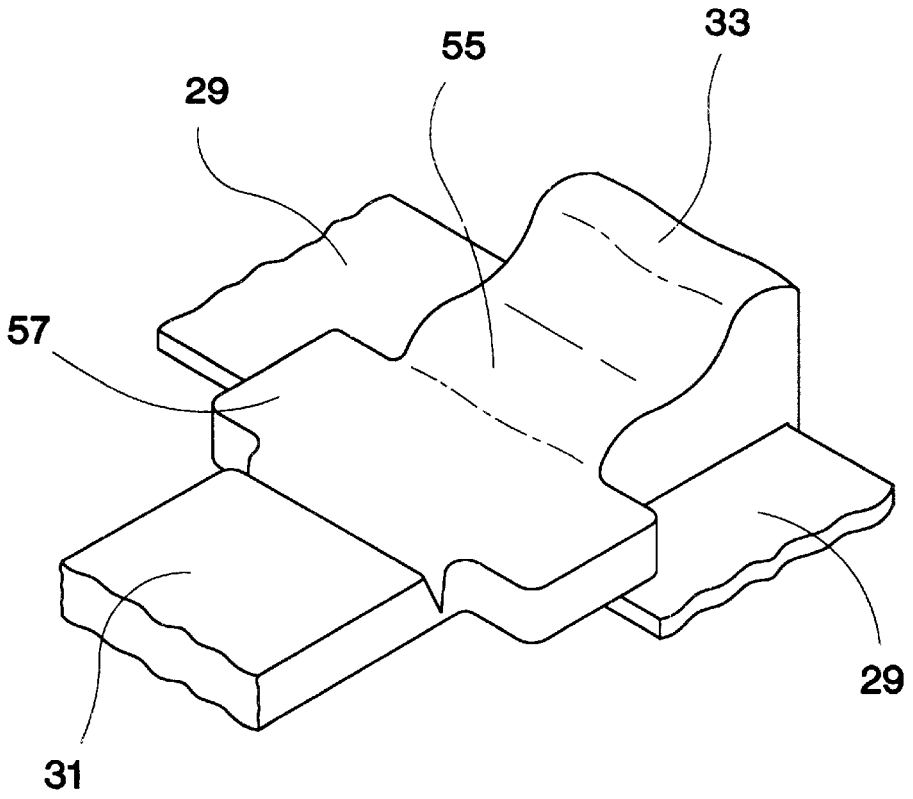
FIG. 4 is a top perspective view of the head rest components.

FIG. 4 is a top perspective view of the head rest components. The "leather look" head rest/shoulder member 33 is supported underneath on the lateral member 29 and the back/spline elongated connecting member 31. This head rest, the member 31 and connecting lateral strap member 29 may be made from injected polyurethane foam rubber material. The upper head rest portion 55 may be elevated and contoured to receive a user's head while laying down while the adjoining lower head rest portion 57 is generally flat before it joins back support member 31.

In use a user would place the lower support structure on a convenient floor space. Next, the user would lay in between the two spaced members 3 and 5 with their back resting along member 31 and facing upwardly with the back of their head on rest 33. Grasping the overhead handle 13 with their hands the user would then pull down moving the upper frame members toward their chest against the resistance of the four pistons. Thus, the capped ends of members 3 and 5 would point down and be lower than their raised ends nearer lateral frame support member 7. No slid rubber protection pads 59 on the bottoms of lower supports 23 and 25 insure the device will not slid. Changing the orientation of the handle free end will result is different muscle groups being exercised. Changing the length of the handle where grasped results in different amounts of force being needed to resist the opposing resistance piston pairs.

The tubular frame components of the preferred embodiment can be manufactured using extruded, steel tubing utilizing conventional cut and weld techniques which are standard and conventional. The steel metal tubing is cut to the proper length using a metal cutting band saw or a tubing cutter. The steel tubing when bent (e.g., members 9 and 11) using a hydraulic tubing bender, to the necessary curvatures to reduce back strain. The steel tubing may be metal punched to provide fixture holes for mounting the headrest, pneumatic piston cylinders, and other components.

The metal punching process involves a male and female die, both are which are machined into the shape of the desired finished product. The dies are made of hardened tool steel, and are placed in the jaws of a hydraulic press. In operation, the steel material to be punched is placed between the two die components and the hydraulic press activated. The two dies quickly "punch out" the desired shape from the sheet metal, producing the desired metal component. A table top "jig" is used to hold the precut metal pieces in accurate alignment for welding. This arrangement provides a high quality end product which is consistent in construction.

If the steel frame tubing were purchased as an "off the shelf" item is would probably be manufactured using the metal extrusion process. The metal extrusion process is one whereby molten, heat softened metal is forced under high pressure through a die, similar to toothpaste being squeezed through the hole in the tube, (in this example the hole in the tube is the die). The metal forms a continuous length in the shape of the die it was squeezed through. In other words the metal would come out continually in the shape of a rod using the nozzle of the toothpaste tube as a die, but would come out in the shape of a square if the die were square. In this case the metal extrusion would take on the shape of the tubular sections. Many familiar parts you deal with on a weekly basis were more than likely extruded. Metal rods, bars, and flats and similar items are all manufactured using the extrusion process.

The headrest 33 and back/spline support 31 could be manufactured using polyurethane foam by the injection molding process under low pressure. Polyurethane foam is a two part ix chemical which when brought together, begins to form a foaming material. Once allowed to completely cure within a few minutes, a foam product is formed (in this case the headrest and support). The mixture is usually injected into a mold, providing a sculptured foam product which is an exact duplicate of the mold the foam was injected into. Polyurethane foam forms a "skin" on the outside which resembles leather. This is especially true if the mold has been "etched" to provide a leather appearance.

The outside of the steel frame tubing can be powder coated. This process involves spraying a dry powdered paint (resin or plastic material) on the metal and curing the powder in a heated oven. Electrical charges may be applied to the sprayed material to insure it adheres to the metal before heating. This process provides a very durable coating to the metal which may take on any desired color. The pneumatic cylinders as well as the protective plastic end caps are all available as "off the shelf" items. The Thomas Register of American Manufacturers is a good source for locating supplier of this type of product. Once all components are manufacture red or purchased, the final (FIG. 1) end product can be assembled by hand.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. An exercise device used to develop a user's torso and upper body muscles comprising:

a frame support structure having two spaced upper frame members each with a first end;

a lateral support connecting said two spaced upper frame members at their first ends;

two lower curved spaced side support members each of which is connected to and extends downwardly from one of the first ends of one of said upper member and the connecting lateral support member;

resistive members connected to and depending from said two spaced upper frame members at their ends remote from the first ends;

two lower floor engaging supports each of which is connected to one of said resistive members at the member's lower end;

a tubular handle assembly having a handle end connected to said lateral support extending upwardly from the lateral support, said handle assembly having an upright member with a plurality of different holes;

a removable pin means selectively insertable into one of said different holes in the upright member for locating and securing the extending handle assembly with respect to the lateral support such that the handle assembly may be oriented and fixed at a plurality of different locations, said means for locating and securing the handle assembly being capable of orienting the handle's end to point between the two spaced upper members or towards either one of said upper members; and a lower back support connecting said two lower curved spaced side support members, said back support being connected by strap members extending between the said curved spaced side support members and said two lower floor engaging supports connected to said resistive members.

* * * * *